US008245890B2

(12) United States Patent
Koch

(10) Patent No.: US 8,245,890 B2
(45) Date of Patent: Aug. 21, 2012

(54) INTAKE NOZZLE FOR A PUMP

(76) Inventor: Edward John Koch, Calgary (CA)

( * ) Notice: Subject to any disclaimer, the term of this patent is extended or adjusted under 35 U.S.C. 154(b) by 299 days.

(21) Appl. No.: 12/419,338

(22) Filed: Apr. 7, 2009

(65) Prior Publication Data

US 2010/0252136 A1 Oct. 7, 2010

(51) Int. Cl.
*F16L 3/00* (2006.01)

(52) U.S. Cl. ..... 222/464.1; 222/382; 222/377; 417/313; 417/572

(58) Field of Classification Search ..... 222/464.1, 222/377, 382, 527, 108, 109; 138/109; 15/322; 137/312; 134/21; 417/523.5, 572; 415/182.1–186
See application file for complete search history.

(56) References Cited

U.S. PATENT DOCUMENTS 3,605,171 A * 9/1971 Candor et al. ..... 15/399
4,156,948 A * 6/1979 Chauvier et al. ..... 15/1.7
5,014,389 A * 5/1991 Ogilvie et al. ..... 15/353
5,032,184 A * 7/1991 Ogilvie et al. ..... 134/21
5,517,715 A * 5/1996 Monson ..... 15/320
5,655,258 A * 8/1997 Heintz ..... 15/415.1
5,720,078 A * 2/1998 Heintz ..... 15/415.1
6,136,098 A * 10/2000 Tribastone ..... 134/21

* cited by examiner

*Primary Examiner* — Kevin P Shaver
*Assistant Examiner* — Donnell Long
(74) *Attorney, Agent, or Firm* — Adrian D. Battison; Ade & Company Inc.

(57) ABSTRACT

An intake nozzle for the inlet pipe of a pump has a vertical duct with a downwardly facing mouth and a surrounding disk shaped intake portion with a bottom surface which faces a flat surface such as a floor or tank bottom to take liquid from the floor down to a shallow depth. The bottom surface is shaped with a flat outer part and an upwardly and inwardly curved inner part converging to the mouth. The surface is shaped and spaced from the flat surface with annular areas defined therebetween so that the liquid enters the peripheral edge slowly and accelerates up to an inner edge of the flat portion and then remains at constant velocity from the inner edge of the flat portion through the mouth and the pipe to the intake of the pump.

8 Claims, 3 Drawing Sheets

INTAKE NOZZLE FOR A PUMP

This invention relates to an intake nozzle for a pump for removing liquid from a surface.

BACKGROUND OF THE INVENTION

It is commonly necessary to pump liquid from a surface in the event of a flood or spill, or from the bottom surface of a tank or containment area to remove the fluid.

Submersible sump pumps are available which sit flat on the surface and can pump down to a relatively low liquid surface level. However these are generally of low capacity and are unsuitable in situations where large volumes of liquid are to be pumped.

A larger volume of flow can be generated using a remote pump with an intake line leading to the surface. Typically such pumps are provided with a generally conical strainer device that fits on the end of the suction line to prevent debris from entering the pump suction. The problem with the strainer device is that it does not allow the pump to pump the fluid level down to the floor. The pump loses suction leaving a significant standing fluid level.

It is desirable to pump the fluid level down as much as possible before losing suction.

The movement of fluid while pumping is caused by creating a pressure differential so that the fluid flows from higher to lower pressure. Because of the design of the strainer, the pump loses suction while there is still a significant amount of water to be pumped from a flat surface. This effect takes place because air breaks through into the pump suction as the fluid level drops, due to the design of the strainer device. This also happens when pumping without the strainer device.

SUMMARY OF THE INVENTION

It is one object of the invention to provide an improved intake nozzle for a pump which allows liquid on a surface to be pumped down to a height of liquid close to the surface.

According to one aspect of the invention there is provided a intake nozzle for a pump comprising:

a cylindrical duct portion defining a circular bottom mouth surrounding a central upstanding axis of the duct portion with the bottom mouth arranged to face downwardly toward an upwardly facing flat surface from which liquid is to be drawn into the mouth;

the duct portion being arranged for connection to an inlet pipe of the pump so that the pump draws liquid from the nozzle into the pump for discharge;

a plate member surrounding the bottom mouth and defining a downwardly facing nozzle surface for facing the flat surface, so that the liquid is drawn between the flat surface and the downwardly facing nozzle surface before entering the bottom mouth;

a plurality of spacer members extending downwardly from the nozzle surface for spacing the nozzle surface from the flat surface;

the nozzle surface being shaped and spaced from the flat surface so as to define an annular gap surrounding the bottom mouth which defines with the flat surface an annular area at the annular gap which is substantially equal to the circular area of the bottom mouth;

the nozzle surface being shaped between the annular gap and the mouth so as to define an inwardly and upwardly extending curved surface portion which is shaped such that an annular area between the surface portion and the flat surface at any circle surrounding the central axis of the bottom mouth is substantially equal to the circular area of the bottom mouth;

the plate member extending outwardly from the annular gap to an outer peripheral edge of the nozzle surface so as to define a peripheral intake mouth between the flat surface and the outer edge of the downwardly facing nozzle surface through which the liquid is drawn to pass under the nozzle surface to the bottom mouth;

the nozzle surface being shaped such that, as it extends outwardly from the annular gap to the peripheral mouth, the annular area at any circle surrounding the central axis between the nozzle surface and the flat surface increases with the radius.

The flat surface can be that of a floor, for example of a basement or other flooded area, or can be a base of a tank, pool or other container to be emptied. Thus in this case the bottom surface of the nozzle simply sits on the floor or base facing downwardly. Alternatively the flat surface maybe a surface forming part of the nozzle itself.

Preferably the nozzle surface is simply flat between the annular gap and the peripheral mouth. Thus the gap remains constant and the increase in circumference acts to gradually increase the annular area at each circle as the radius increases. Alternatively the gap may gradually increase or may gradually decrease provided the annular area increases, since the gradual increase acts to slow the velocity of the liquid as it enters and passes through the gap under the nozzle surface.

Preferably the outer peripheral edge is located at a diameter which is at least double the diameter at the annular gap since this provides a relatively large area at the peripheral edge to cause a low velocity at the edge which increases significantly as it approaches the annular gap.

Preferably the annular gap is located at a diameter which is at least double the diameter of the bottom mouth. In this way the liquid flow gradually and smoothly changes in direction from the horizontal direction under the nozzle surface into the vertical direction as it passes through the bottom mouth. It will be appreciated that the larger the radius of the device, the more efficient it will be at reducing the gap so as to reduce the velocity and thus the likelihood of air breakthrough at the gap. Different models can be provided for different pump sizes with different gaps and different overall diameters.

The suction tube can be integral with the duct portion of the nozzle or can be separate with a suitable coupling.

Preferably the plate member is circular at the peripheral edge, although other shapes are possible.

Preferably the duct is vertical and defines an upper open mouth, for connection to the intake pipe of the pump, which is spaced above the plate member.

This leads the liquid away from the nozzle with minimum direction changes, although the duct may include an elbow which changes the direction to a horizontal direction across the surface. The duct may contain a screen type filter to prevent debris entering the pump if the device loses contact with the surface while the pump is operating.

Preferably the spacer members extend from the nozzle surface at positions spaced outwardly of the annular gap so as not to interfere with the flow in the area of the annular gap and the curved surface interconnecting it to the bottom mouth.

Preferably the spacer members are relatively small and thus are arranged so as to avoid reducing the annular area at a circle intersecting the spacer member to an area less than the circular area of the bottom mouth. That is the spacer members are merely supports to hold the nozzle surface spaced from the floor or base and are not intended to guide liquid flow.

Thus the arrangement as described hereinafter provides a new pump suction device. The device as described may have one or more of the following features and advantages:

It is a round device that sits on the bottom surface to be pumped. It has a large surface area in comparison with the mouth of the pipe and sits very close to the surface.

Because the device sits very close to the surface, it acts as a strainer and prevents debris from entering the pump suction. The debris cannot fit into the gap between the device and the floor.

The flow path through the device is carefully designed to reduce the fluid velocity at the edges of the device. The fluid velocity creates fluid friction, and the pressure drop created is proportional to the friction so that a lower velocity provides less pressure drop and less flow reduction. The suction line for any given pump size has a fixed Pump Total Flow Area (TFA) which this is the cross sectional area of the pump suction line. The TFA for a pump is determined by the size of the suction. In this device the TEA is held constant through the device from the annular gap through the bottom mouth, such that the flow area between the floor and the device is the same as the pump suction TFA at annular gap defined by the nozzle profile. The device extends beyond the annular gap to the outer periphery, and as it extends out, the flow area of the gap increases with the radius. This increase in gap flow area results in a proportional decrease in fluid velocity. Thus the fluid enters the gap at the edge of the device at a slow speed. It accelerates towards the center of the device. When it reaches the annular gap at the outer edge of the nozzle profile, it will reach constant speed. It will then maintain the constant speed through the nozzle area and the pump suction tube and suction hose (all the way to the pump).

The pump works by reducing the pressure at the suction. This reduced pressure causes the fluid to flow to the pump. By increasing the flow area at the outside edge of the gap (above the TFA), this device reduces the unit pressure drop at the outside edge of the nozzle. This is why the velocity of the fluid into the edge of the device is lower than the velocity through the suction hose. This low velocity reduces the pump suction so as to reduce the possibility of air breakthrough and is a key feature in allowing the device to lower the fluid level as close to the floor as is possible.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
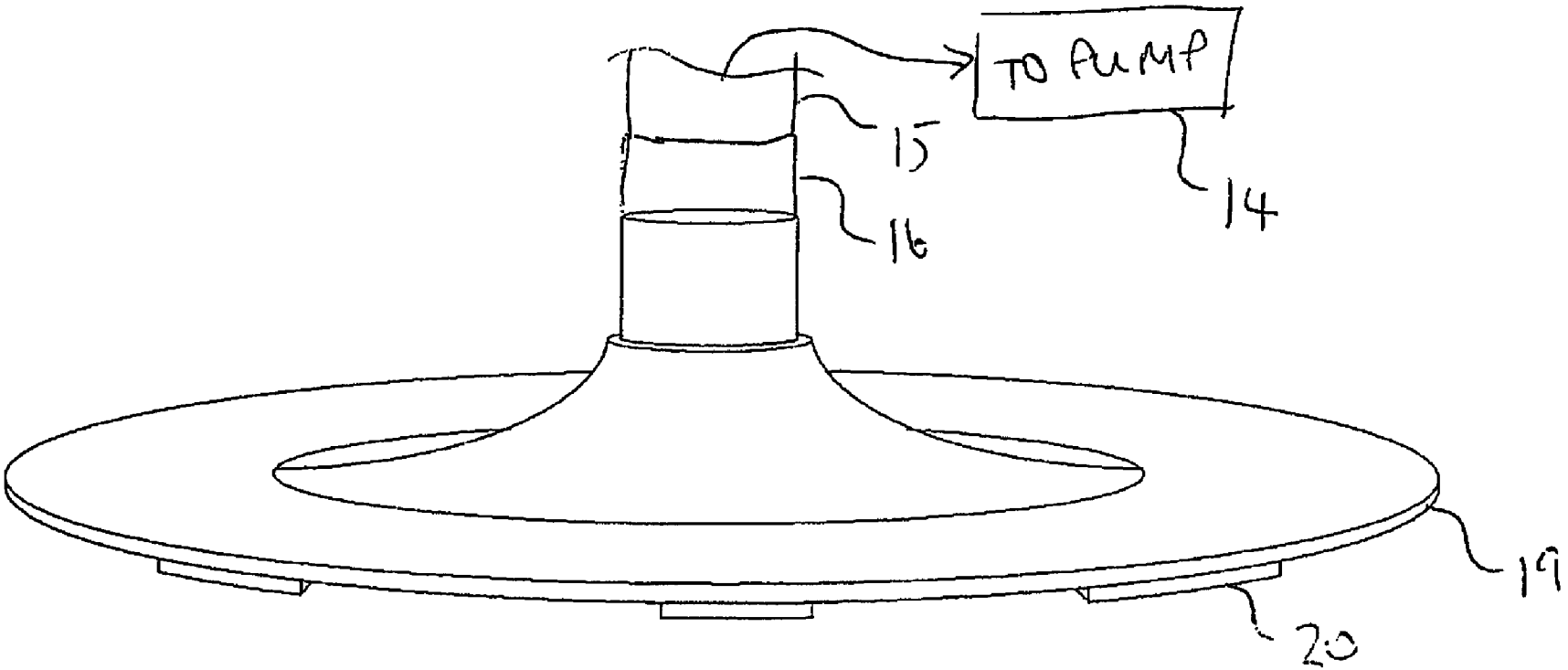
FIG. 1 is an isometric view of a nozzle according to the present invention.
Figure 2:
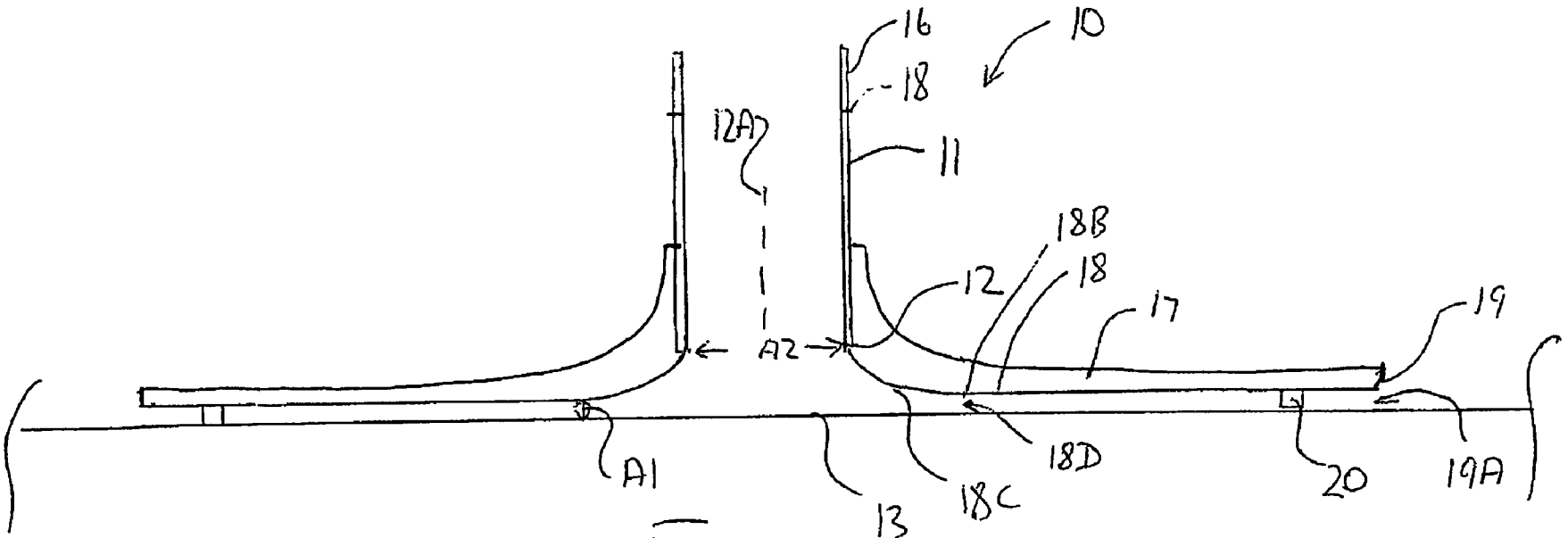
FIG. 2 is a vertical cross sectional view of the nozzle of FIG. 1.
Figure 3:
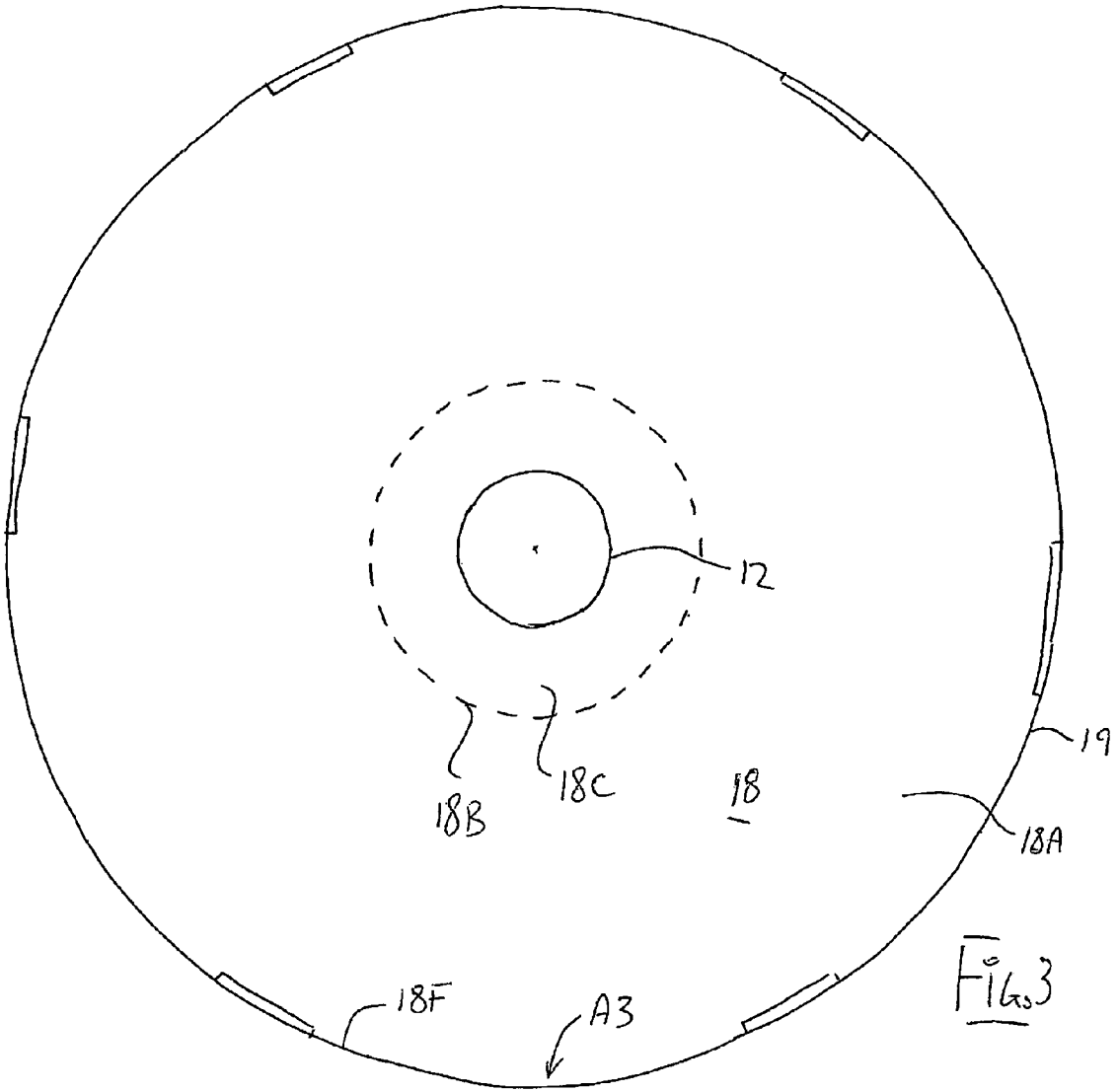
FIG. 3 is a bottom plan view of the nozzle of FIG. 1.

The embodiment of the intake nozzle 10 shown in the drawings is arranged to sit on a flat surface 13 to remove liquid from the surface by the suction of the pump 14 which has an intake line 15 connected by a coupling 16 to the nozzle.

The nozzle comprises a cylindrical duct portion 11 and a plate member 17 surrounding the duct portion. The duct portion stands vertically upwardly and defines a circular bottom mouth 12 surrounding a central upstanding axis 13 of the duct portion and a circular upper end 18 which connects to the circular pipe 15 with a common inner diameter through the connection and to the pump.

The bottom mouth 12 faces downwardly toward the upwardly facing flat surface 13 from which liquid is to be drawn into the mouth.

The plate member 17 surrounding the bottom mouth and defines a downwardly facing nozzle surface 18 facing the flat surface 13, so that the liquid is drawn between the flat surface and the downwardly facing nozzle surface to flow inwardly from an outer edge 19 of the plate member before entering the bottom mouth 12.

The surface 18 is supported from the surface 13 by a plurality of spacer members 20 extending downwardly from the nozzle surface arranged at a height for spacing the nozzle surface from the flat surface by a predetermined required distance. The spaced members are small in relation to the area of the bottom surface 18 so as to avoid interfering with flow through the gap and can be located at any suitable location at or adjacent the peripheral edge 19.

The nozzle surface 18 forms a flat annular portion 18A from the edge 19 to an inner edge 18B of the flat portion surrounding the bottom mouth 12 which is spaced outwardly of the mouth.

The nozzle surface 18 is shaped between the edge 18B and the mouth 12 so as to define an inwardly and upwardly extending surface portion 18C which is smoothly curved upwardly and inwardly to the mouth 12.

The nozzle surface 18 defines an annular gap 18D at the edge 18B extending from the nozzle surface to the flat surface which defines an annular area A1 at the annular gap 18D as defined by the height of the gap 18D multiplied by the circumference of the circle at the gap 18D. This area A1 is arranged to be substantially equal to the circular area A2 of the bottom mouth, which is equal to the area of the intake pipe 15.

The portion 18C of the nozzle surface 18 is shaped such that the annular area A1 defined vertically between the nozzle surface 18C and the flat surface 13 at any circle surrounding the central axis 12A of the bottom mouth is substantially equal to the area A1. Thus the area of the annular gap remains constant from the gap 18D through to the mouth 12. The mathematical shape of the curved surface to achieve this condition can be readily calculated or designed and typically a curve known as a 'power law' curve or a 'radial distribution' can achieve this condition.

The plate member extends outwardly from the annular gap 18D at the inner edge 18C of the flat portion 18A to the outer peripheral edge 19 of the nozzle surface so as to define a peripheral intake mouth 19A between the flat surface 13 and the outer edge 19 of through which the liquid is drawn to pass under the nozzle surface to the bottom mouth. This gap acts as a strainer or filter to prevent the entry of over-size debris into the mouth 12 which could interfere with the operation of the pump.

Of course it will be appreciated that the flat nozzle surface, as it extends outwardly from the annular gap 18D to the peripheral mouth 19, the annular area at any circle surrounding the central axis increases with the radius. In this way the velocity of the liquid entering the gap 19 is at its slowest and it gradually increases to the gap 18D, from which the velocity remains constant through the mouth 12 and the pipe to the pump.

As the plate member is relatively large compared with the mouth 12, the outer peripheral edge 19 is located at a diameter which is at least double the diameter at the annular gap 18D.

Also the annular gap 18D is located at a diameter which is at least double the diameter of the bottom mouth 12.

The spacer members 20 are located at positions spaced outwardly of the annular gap 18D so that they do not interfere with the flow in the constant velocity area between the gap 18D and the mouth 12. They are sufficiently small that they avoid reducing the annular area A3 at a circle 18F intersecting the spacer members to an area less than the circular area A1 of the bottom mouth and preferably the area A4 is much greater than the area A1 so that the velocity is slow as the liquid passes the spacer members 20.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. An intake nozzle for a pump comprising:

a cylindrical duct portion defining a circular bottom mouth surrounding a central upstanding axis of the duct portion with the bottom mouth arranged to face downwardly toward an upwardly facing flat surface from which liquid is to be drawn into the mouth;

the duct portion being arranged for connection to an inlet pipe of the pump so that the pump draws liquid from the nozzle into the pump for discharge;

a plate member surrounding the bottom mouth and defining a downwardly facing nozzle surface for facing the flat surface, so that the liquid is drawn between the flat surface and the downwardly facing nozzle surface before entering the bottom mouth;

a plurality of spacer members extending downwardly from the nozzle surface for spacing the nozzle surface from the flat surface;

the nozzle surface being shaped and spaced from the flat surface so as to define an annular gap surrounding the bottom mouth which defines with the flat surface an annular area at the annular gap which is substantially equal to the circular area of the bottom mouth;

the nozzle surface being shaped between the annular gap and the mouth so as to define an inwardly and upwardly extending curved surface portion which is shaped such that an annular area between the surface portion and the flat surface at any circle surrounding the central axis of the bottom mouth is substantially equal to the circular area of the bottom mouth;

the plate member extending outwardly from the annular gap to an outer peripheral edge of the nozzle surface so as to define a peripheral intake mouth between the flat surface and the outer edge of the downwardly facing nozzle surface through which the liquid is drawn to pass under the nozzle surface to the bottom mouth;

the nozzle surface being shaped such that, as it extends outwardly from the annular gap to the peripheral mouth, the annular area at any circle surrounding the central axis between the nozzle surface and the flat surface increases with the radius.

2. The intake nozzle according to claim 1 wherein the nozzle surface is flat between the annular gap and the peripheral mouth.

3. The intake nozzle according to claim 1 wherein the outer peripheral edge is located at a diameter which is at least double the diameter at the annular gap.

4. The intake nozzle according to claim 1 wherein the annular gap is located at a diameter which is at least double the diameter of the bottom mouth.

5. The intake nozzle according to claim 1 wherein the plate member is circular at the peripheral edge.

6. The intake nozzle according to claim 1 wherein the duct is vertical and defines an upper open mouth, for connection to the intake pipe of the pump, which is spaced above the plate member.

7. The intake nozzle according to claim 1 wherein the spacer members extend from the nozzle surface at positions spaced outwardly of the annular gap.

8. The intake nozzle according to claim 1 wherein the spacer members are arranged so as to avoid reducing the annular area at a circle intersecting the spacer member to an area less than the circular area of the bottom mouth.

* * * * *